US007963822B2

(12) United States Patent
Simpson

(10) Patent No.: US 7,963,822 B2
(45) Date of Patent: Jun. 21, 2011

(54) BRASSIERE WITH REINFORCED EDGES

(75) Inventor: Elisabeth Simpson, Hong Kong (CN)

(73) Assignee: Triumph Intertrade AG, Bad Zurzach (CH)

( * ) Notice: Subject to any disclaimer, the term of this patent is extended or adjusted under 35 U.S.C. 154(b) by 479 days.

(21) Appl. No.: 12/116,203

(22) Filed: May 7, 2008

(65) Prior Publication Data

US 2009/0061732 A1 Mar. 5, 2009

(30) Foreign Application Priority Data

Aug. 27, 2007 (DE) ..... 20 2007 011 983 U

(51) Int. Cl.
*A41C 3/00* (2006.01)

(52) U.S. Cl. ..... 450/39; 450/92

(58) Field of Classification Search ..... 450/1, 74, 450/75, 92, 93, 39, 83, 84; 2/272, 275; 156/60, 156/73.1, 73.2, 73.3
See application file for complete search history.

(56) References Cited

U.S. PATENT DOCUMENTS

| | | | | |
|---|---|---|---|---|
| 2,988,087 | A * | 6/1961 | Krieger | 450/81 |
| 3,639,917 | A * | 2/1972 | Althouse | 2/270 |
| 3,868,729 | A * | 3/1975 | Lynam | 2/237 |
| 5,167,566 | A * | 12/1992 | Novitsky et al. | 450/74 |
| 5,171,182 | A * | 12/1992 | Heinen | 450/74 |
| 6,164,227 | A * | 12/2000 | Itoh | 112/475.06 |
| 6,837,771 | B2 * | 1/2005 | Falla | 450/39 |
| 7,678,220 | B2 * | 3/2010 | Lau | 156/216 |
| 7,735,448 | B2 * | 6/2010 | Rahimi | 118/325 |

* cited by examiner

*Primary Examiner* — Gloria Hale
(74) *Attorney, Agent, or Firm* — Muncy, Geissler, Olds & Lowe, PLLC

(57) ABSTRACT

A brassiere is provided having a front piece incorporating two breast cups and with two side pieces extending around the upper body of an individual wearing the brassiere, which side pieces can be connected to one another in a back closure and with two shoulder straps that extend from the upper edge of the breast cups to the back area of the side pieces. The base material of the brassiere is reinforced on at least part of its edge by applying facing bands or the like. In accordance with the invention it is provided that to form an edge reinforcement, in each case a facing band is fixed with a longitudinal edge to the corresponding edge of the blank made of the base material of the brassiere by linear ultrasonic welding and also is fixed at least partially in a two-dimensional manner with the base material by means of an adhesive layer.

15 Claims, 3 Drawing Sheets

BRASSIERE WITH REINFORCED EDGES

This nonprovisional application claims priority under 35 U.S.C. §119(a) to German Patent Application No. 20 2007 011 983.6, which was filed in Germany on Aug. 27, 2007, and which is herein incorporated by reference.

BACKGROUND OF THE INVENTION

1. Field of the Invention

The invention pertains to a brassiere.

2. Description of the Background Art

Brassieres of this type are known and are encountered worldwide in many variations. They are usually made up of a front part, which essentially comprises two breast cups, which can be shaped in a great variety of ways and which are connected over a center bridge. The outer side edges of the front part have attached side parts, the free ends of which can be connected by a back closure in the back area of an individual wearing the brassiere. The side parts can be sewn to the front part, but may also be designed in one piece with it. Since such brassieres have as their essential function both lifting and supporting and also shaping the bust, as a rule they are provided with shoulder straps in the form of supporting straps which connect the breast cups with the back ends of the side parts. Naturally it is expected that such brassieres, in addition to high wearing comfort, will have an attractive external appearance.

Aside from the fact that such brassieres are generally made of several parts connected together by seams sewn with thread, as edge reinforcements along their edges they often have retaining, edging or facing strips, which, since especially the side parts often consist of elastic materials, are generally fastened by means of zigzag seams. In practice it has been found that such seams are often visible under the outer clothing, which leads to impairment of the external appearance of the clothing.

In addition, the strips fixed by seams, usually arranged on the inside of the brassiere primarily for optical reasons, come into direct contact with the skin of the brassiere wearer, which can lead to skin irritations especially in sensitive individuals, and considerably interferes with the wearing comfort. Although the use of facing strips with at least one soft, plush-like surface generally means that the sewing threads sink into the plush-like material, this in turn has the drawback that these facing strips, thicker because of their plush-like quality, are visible beneath the outer clothing. This especially involves the seams in the area of the side parts of a brassiere, since good fit of the brassiere presumes appropriate tensioning of the side parts that are pressed against the upper body of the wearer.

The drawbacks of seams that are visible from the outside under the outer clothing, or, facing inward, show a tendency toward skin irritations, are especially seen in brassieres in which the side parts consist of two or more layers of a textile material which is seamed along the free edges and in view of the elasticity of the material employed is connected together by zigzag seams. An additional thickening of the edge areas often follows from the necessity of folding over the border of the base material to prevent raveling of the edge.

SUMMARY OF THE INVENTION

Against this background, the invention is based on the task of improving a known brassiere in terms of its wearing comfort and external appearance.

In an embodiment of the invention, provided is the fastening together of facing strips serving for edge reinforcement, especially of the side parts, with flat, interior connecting means, especially an adhesive layer. Raveling of the base material at the free edge is prevented in that this and the respective facing strip are connected together on their common outer edges by a seam welded by ultrasound. As a result, it is no longer necessary to fold over the border of the base material, so that the thickening that this would cause is avoided.

The external appearance of the brassiere is improved in that the respective facing strip is first applied to its marginal area flush with the edge on the outside of the base material and is connected to it along the edge by ultrasonic welding, while the facing strip is then folded over around the edge to the inside of the base material and finally connected on the surface with the base material by an adhesive layer. In this way it is accomplished that the ultrasonic weld seam is only recognizable from the inside of the respective side part as a weak line traveling along the free edge, but because of its structure, does not give rise to skin irritation.

Through the formation of edge reinforcements in accordance with the invention, especially on the side parts of brassieres, any seams made with thread are omitted; however, it is a prerequisite that both the base material of the brassiere and the facing strips, which are advantageously elastic, consist at least partially of thermoplastic material that can be melted at points through the action of ultrasound.

The invention cannot only be accomplished in the case of one-layered side parts. Instead it is also possible to cover the inside of the base material including the facing strips applied as edge reinforcement by an additional layer of base material to further improve the wearing properties of such a brassiere.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
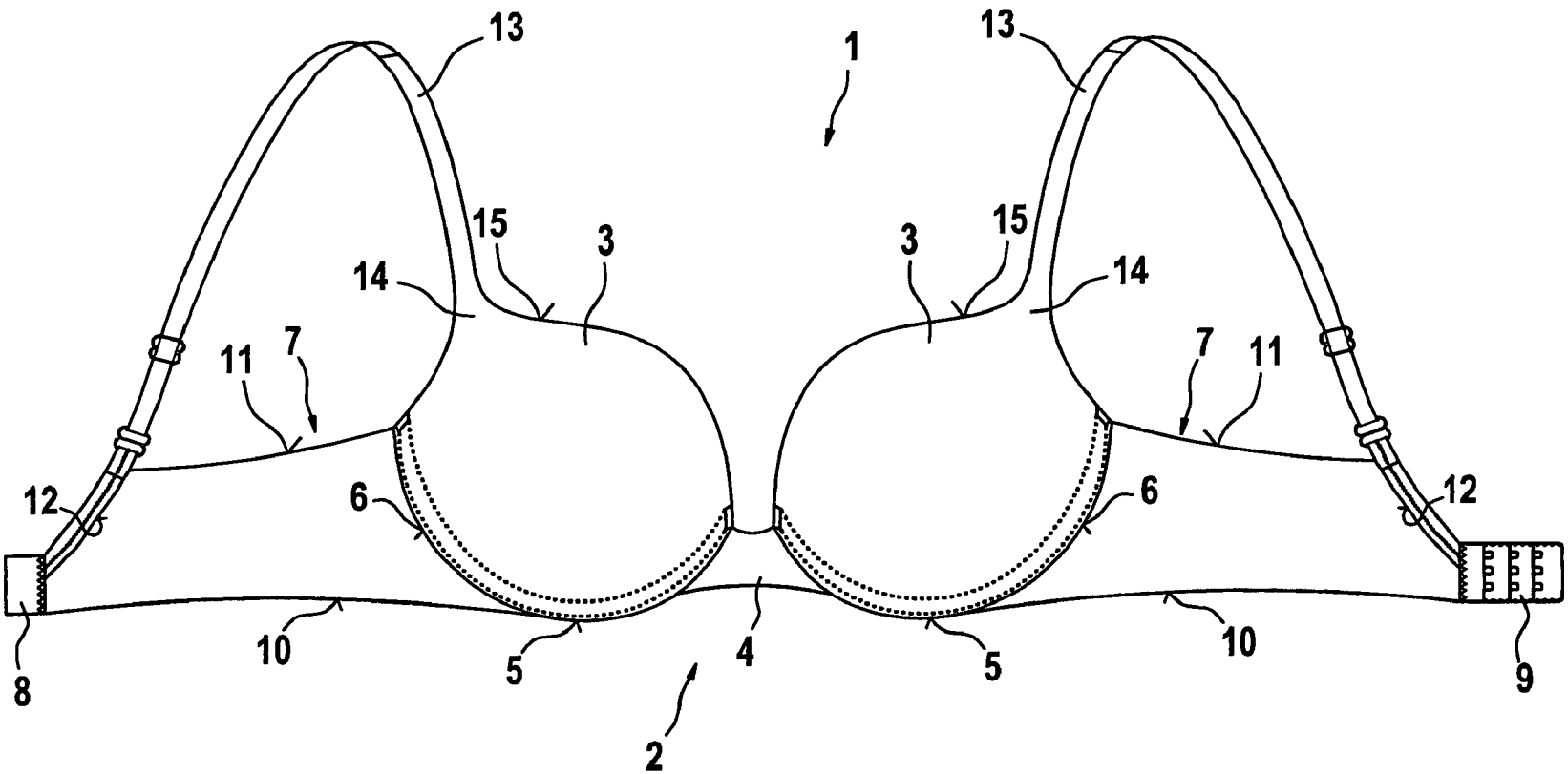
FIG. 1 is a front view of a brassiere in accordance with the invention.

In FIG. 1, a brassiere 1 in accordance with the invention is shown in a view from the front. The brassiere 1 has a front part 2 with 2 breast cups 3 for receiving the breasts. The breast cups 3 can be designed in a known way, thus for example can include a foam core covered on the inside and outside with a textile material, or may be provided with a stiffening wire on the lower and side edges. The breast cups 3 are connected together by a center bridge 4, which is somewhat trapezoidal in shape in the present example.

Along the lower edge 5 and side edge 6 of the breast cups, the side parts 7 are attached, of which the left side part shown in the drawing has an eye strip 8 on its back end, whereas the opposite side part 7 is provided at its end with a hook strip 9. The eye strip 8 and the hook strip 9 interact in a manner known in and of itself to form a back closure. In addition, the side parts 7 are delimited by a lower edge 10, an upper edge 11 and a back edge 12.

As FIG. 1 also shows, the brassiere 1 in accordance with the invention has shoulder straps 13, which travel from a strap attachment 14 at the upper edge 15 of the breast cups 3 to the back edge 12 of the side parts 7 and along this edge to the parts of the back closure, thus the eye strip 8 and the hook strip 9 respectively.

Figure 2:
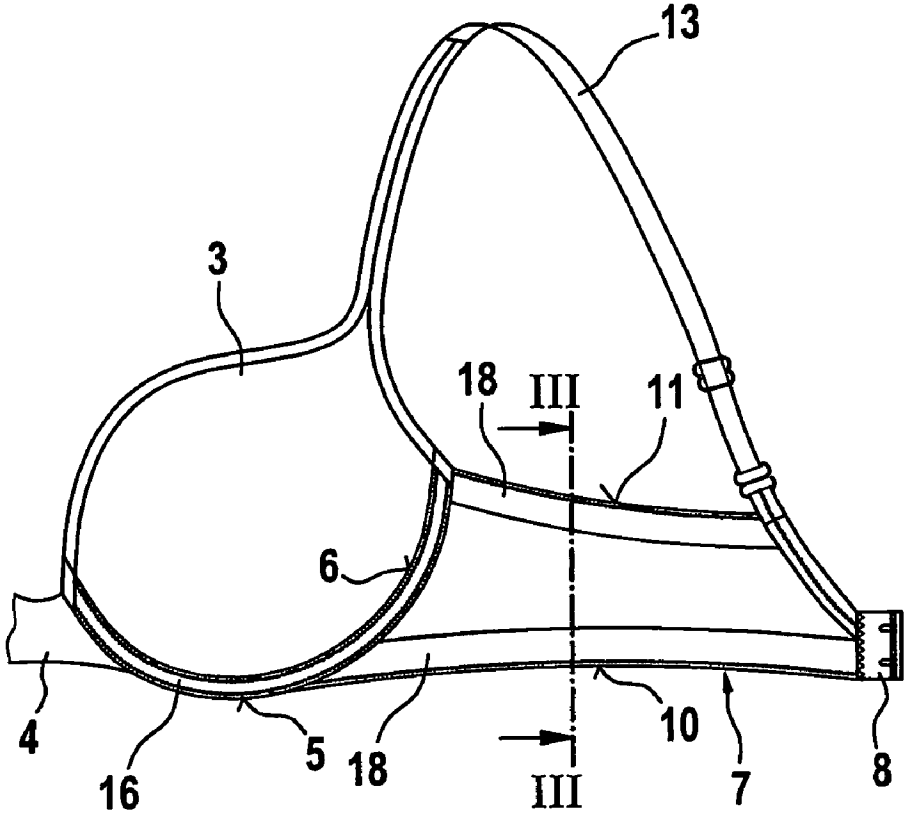
FIG. 2 is an inside view of a breast cup with its continuing side part.

Whereas FIG. 1 shows the front view of a brassiere in accordance with the invention, in FIG. 2 an interior view of only one breast cup 3 with side part 7 adjacent to it is shown. Here it is also indicated how the breast cup 3 can be reinforced by a stiffening wire 16 traveling along the lower edge 5 and the side edge 6.

Figure 3:
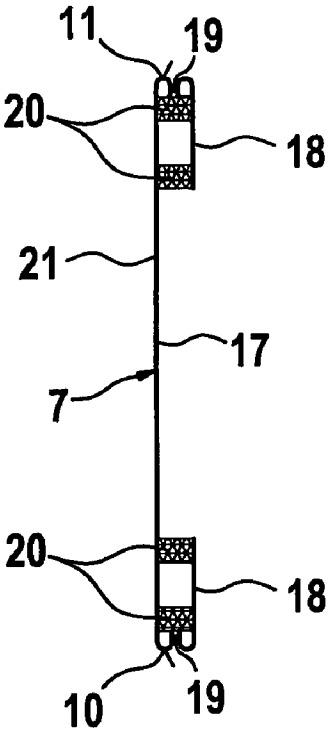
FIG. 3 is a cross section along line III-III in FIG. 1.

As is shown especially by FIG. 3, which shows a section through the side part 7 along the line III-III in FIG. 2, the side part 7 consists of a layer 17 of a base material. As a rule this is a textile, usually elastic material, which is made at least partially from thermoplastically deformable fibers. As FIG. 2 in combination with FIG. 3 indicates, both the lower edge 10 of the side part 7 and its upper edge 11 are each reinforced by a facing strip 18. The facing strip 18, which advantageously likewise consists of an elastic material and contains thermoplastically deformable fibers, is connected on its outer edge, corresponding to the outer edge of the base material 17, with the base material by an ultrasonically welded seam 19, which is not visible from the outside of the brassiere 1 (see FIG. 1). Whereas this ultrasonically welded seam 19 shows only linear fixation, the actual connection between the facing strip 18 and the—inner—surface 22 of the base material 17 consists of an adhesive layer 20, which either covers the entire surface of the facing strip 18 or, as is recognizable in FIG. 3, is provided only in strips along the edges of the facing strip 18.

The production of this connection of the parts is accomplished advantageously as follows. The facing strip 18 is first applied along the edges 10 and 11 to the outer surface 21 of the base material 17; then the ultrasonically welded seam 19 is applied along the edges 10 and 11. After this, the facing strip 18 with the weld seam 19 is folded respectively around the edges 10 and 11, and the two-dimensional connection between the facing strip 18 and the inner surface 22 of the base material 17 is produced by the adhesive layer 20.

The adhesive layer 20 advantageously includes a thermosensitive adhesive. In this way, by applying pressure and/or heat, intensive bonding of the parts with one another can be achieved. In this process the adhesive layer 20 can be applied in the form of an adhesive strip. However, it is also possible either to directly coat the surfaces to be bonded together with a suitable adhesive, which can be activated appropriately by application of pressure and/or heat, or to use a facing strip 18 that is already coated on one side in advance with an appropriate adhesive. Adhesives that meet these requirements are known.

In a corresponding manner to the longitudinal edges of the side parts 7, the edges of the center bridge 14 can also be secured, namely in the case of the two-layered material, by ultrasonic welding at the edges and subsequent folding over, as well as the shoulder straps 13, in the case of which the edges of a strap-like blank of the base material are folded laterally around a shoulder strap and connected to it by means of an adhesive layer.

Figure 5:
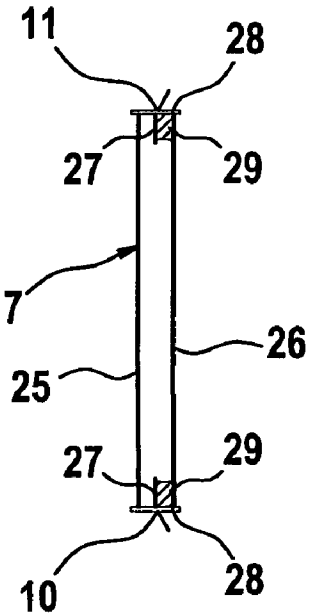
FIG. 5 is a cross section along line V-V in FIG. 4.
Figure 4:
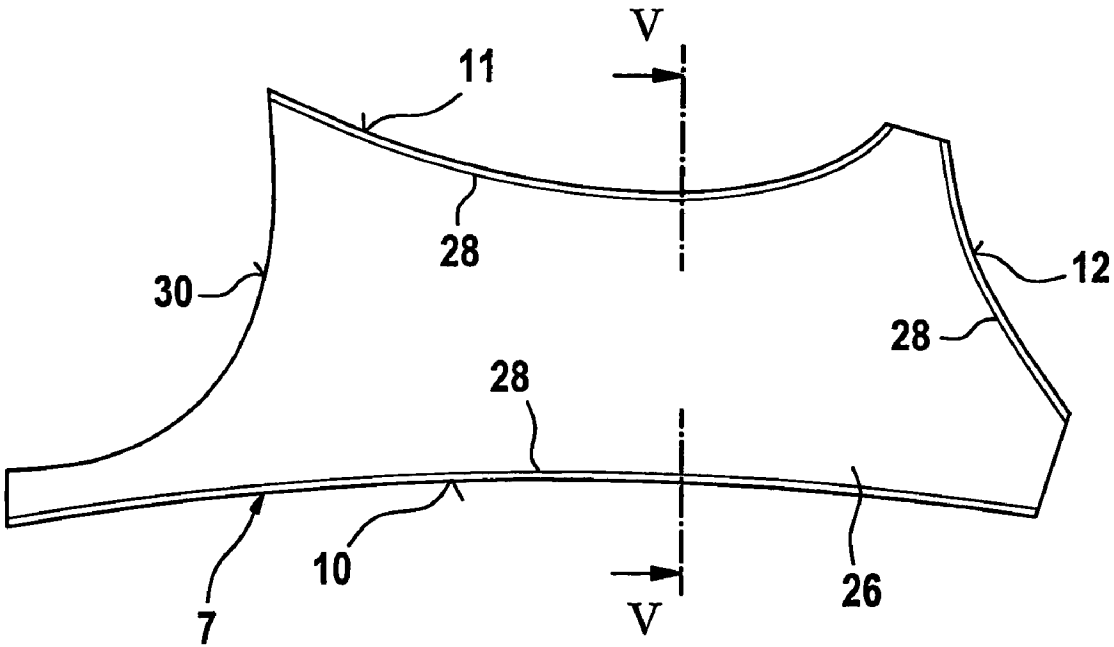
FIG. 4 is a schematic interior view of a side part of a different embodiment of a brassiere.

FIGS. 4 and 5 also show the procedure to be followed when the side parts 7 of the brassiere 1 consist of two layers of the base material, wherein the respective interior layer, facing the body of the wearer, completely covers the facing strips attached to the edges as edge reinforcement.

FIG. 4 is a schematic interior view of the side part 7, and FIG. 5 is a section along line V-V in FIG. 4. Here, FIGS. 4 and 5 respectively show the end state of the relevant side part 7, thus the state in which this side part 7 is connected with the other parts of the brassiere 1, thus with the front part with the breast cups, with the back closure parts and with the shoulder straps.

In particular, FIG. 5 shows how the side part 7 consists of two layers of a base material, namely an outer layer 25 and an inner layer 26. Here, facing strips 27 are located both on the lower edge 10 and on the upper edge 11 of the side part 7, in each case between the layers 25 and 26; they are fixed with the two layers 25 and 26 respectively by an ultrasonic weld seam 28 and in each case connected with the inner layer 26 of the base material by means of an adhesive layer 29.

In terms of process, the production of these two-layer side parts can be described as follows. In the first process step, the facing strips 27 are applied to the edges of the blank of the inner layer 26 of the base material; [these strips] are advantageously already coated with the adhesive layer 29 on the side facing the inner layer 26. Here, the adhesive layer 29 can be applied directly to the respective facing strip, or an appropriately coated adhesive strip can be placed between the facing strip and the layer of the base material. Then this inner layer 26 of the base material with the facing strips 27 is placed on the outer layer 25 of the base material, specifically in that in each case the sides of the two layers of the base material are superimposed on one another, which in the final state are to form the outsides of the side part 7. In this state all parts are fixed relative to one another by means of an ultrasonic weld seam 28. This weld seam not only brings about bonding of the parts, but also a clean separating line.

In a next step, the side part 7 prepared in this way is turned over, i.e., the inner surfaces are turned to the outside. This can take place through the open, inner edge 30 in the case of the side part 7 shown in FIG. 4, which is designed for sewing the side part 7 to the front part 2 or to a breast cup 3. As a result of this turning over, the layers 25 and 26 of the base material, initially facing one another, are turned so that their outer sides come to lie toward the outside, whereas the facing strips 27 are located on the inside between the two layers 25 and 26 of the base material.

As a result of the turning over of the two-layered side parts 7, the ultrasonic weld seams 28 come to lie on the inside of the side parts 7 right against the edges, as is recognizable in the interior view of FIG. 4.

In a finishing process step, the adhesive layer 29 between the facing strips 27 and the inner layer 26 of the base material is activated by application of pressure and/or heat, and thus the interaction of the individual parts is optimized with the smallest possible development of thickness.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A brassiere comprising:

a front part having two breast cups; and two side parts having longitudinal edges and configured to surround an upper body of an individual wearing the brassiere, which can be connected to one another with a back closure and with two shoulder straps, which extend from an upper edge of the breast cups to a back area of the side parts, wherein a base material of the brassiere is reinforced along at least part of the side part edges by facing strips to form edge reinforcements, and wherein, for forming the edge reinforcement in each case, one facing strip is fixed to the corresponding edge of the base material of the brassiere in a linear manner by ultrasonic welding and is connected to the base material by an adhesive layer at least partially in a two-dimensional manner.

2. The brassiere according to claim 1, wherein the facing strips extend along the upper edge of the breast cups and/or the longitudinal edges of the side parts and/or longitudinal edges of the shoulder straps.

3. The brassiere according to claim 1, wherein at least part of the facing strips includes elastic material.

4. The brassiere according to claim 1, wherein the adhesive layer has a thermosensitive material.

5. The brassiere according to claim 1, wherein the adhesive layer extends in a strip along longitudinal edges of the facing strips.

6. The brassiere according to claim 1, wherein the adhesive layer is applied directly to a marginal zone of the base material of the brassiere, by a process of spraying, rolling or applying pressure.

7. The brassiere according to claim 1, wherein the adhesive layer is applied directly to the facing strip.

8. The brassiere according to claim 1, wherein the adhesive layer is applied to an adhesive strip that is arranged for fixing the respective facing strip between this and the base material of the brassiere.

9. The brassiere according to claim 8, wherein the adhesive strip has elastic properties.

10. The brassiere according to claim 1, wherein the adhesive layer has polyurethane, polyolefin or a thermoplastic elastomer.

11. The brassiere according to claim 1, wherein the side parts include a layer of the base material and the adhesive layer is arranged between the facing strip and the base material.

12. The brassiere according to claim 1, wherein the side parts have two layers of base material and the adhesive layer is arranged between the facing strip and in each case one layer of the base material.

13. The brassiere according to claim 12, wherein the adhesive layer is arranged between the facing strip and an inner layer of the side part facing the body of the wearer of the brassiere.

14. A method of fabricating a brassiere including a front part having breast cups and side parts formed from a base material, the side parts being configured to surround an upper body of an individual wearing the brassiere and connectable to each other with a back closure, the method comprising:

applying at least one facing strip to an outer surface of the base material and along an edge of the base material;

ultrasonically welding each facing strip in place along the edge of the base material;

folding each facing strip around the edge of the base material; and applying an adhesive layer to each folded facing strip and an inner surface of the base material to form a two-dimensional connection.

15. A brassiere with reinforced edges, comprising:

a front part having breast cups;

side parts formed from a base material, the side parts being configured to surround an upper body of an individual wearing the brassiere and connectable by a back closure; and at least one edge-reinforcing facing strip that is ultrasonically welded to an edge of an outer surface of the base material and connected by an adhesive layer to an inner surface of the base material to form a two-dimensional connection.

* * * * *